US010060169B2

(12) United States Patent
Chen et al.

(10) Patent No.: US 10,060,169 B2
(45) Date of Patent: Aug. 28, 2018

(54) FURNITURE HINGE

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Ting-Tsai Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/651,083

(22) Filed: Jul. 17, 2017

(65) Prior Publication Data

US 2018/0128030 A1 May 10, 2018

(30) Foreign Application Priority Data

Nov. 10, 2016 (TW) ..... 105136759 A

(51) Int. Cl.

| | |
|---|---|
| ***E05F 1/08*** | (2006.01) |
| ***E05D 7/04*** | (2006.01) |
| ***E05D 7/081*** | (2006.01) |
| ***E05D 11/10*** | (2006.01) |
| ***E05F 1/12*** | (2006.01) |
| *E05D 7/00* | (2006.01) |

(52) U.S. Cl.

CPC ..... *E05D 7/0415* (2013.01); *E05D 7/0407* (2013.01); *E05D 7/081* (2013.01); *E05D 11/1014* (2013.01); *E05F 1/1215* (2013.01); *E05D 7/00* (2013.01); *E05Y 2900/20* (2013.01)

(58) Field of Classification Search

CPC ... E05D 11/1014; E05D 11/1021; E05D 7/00; E05D 7/0415; E05D 7/123; E05D 7/12; E05D 7/125; E05D 7/04; E05D 7/0407; E05D 7/0423; E05D 7/081; E05D 2007/0492; E05D 3/142; E05Y 2600/502; E05Y 2600/51; E05Y 2600/626; E05Y 2800/178; E05Y 2900/20; E05F 5/006; E05F 1/1284; Y10T 16/5321; Y10T 16/5322; Y10T 16/53225; Y10T 16/53826; Y10T 16/5383; Y10T 16/53832

See application file for complete search history.

(56) References Cited

U.S. PATENT DOCUMENTS 4,654,930 A * 4/1987 Lautenschlager, Jr. ..... E05D 11/1021 16/288

5,012,551 A * 5/1991 Beneke ..... E05F 5/006 16/49

(Continued)

*Primary Examiner* — Chuck Y Mah

(74) *Attorney, Agent, or Firm* — Rosenberg, Klein & Lee

(57) ABSTRACT

A furniture hinge includes an arm member, a casing, an inner link, an outer link, and a resilient device. The arm member includes at least one wall. The at least one wall includes a first mounting structure. The casing can be opened and closed with respect to the arm member. Each of the inner link and the outer link has two end portions respectively and pivotally connected to the arm member and the casing via shafts. The resilient device provides a resilient force acting between the casing and the arm member and includes a second mounting structure to be mounted to the first mounting structure.

20 Claims, 5 Drawing Sheets

(56) References Cited

U.S. PATENT DOCUMENTS

| | | | | |
|---|---|---|---|---|
| 5,022,117 | A * | 6/1991 | Lautenschlager | E05D 11/1021 16/288 |
| 5,029,362 | A * | 7/1991 | Prodan | E05D 11/1021 16/236 |
| 5,201,096 | A * | 4/1993 | Dubach | E05D 7/0407 16/235 |
| 5,444,895 | A * | 8/1995 | Salice | E05D 7/0407 16/245 |
| 5,493,759 | A * | 2/1996 | Salice | E05D 7/0407 16/238 |
| 6,401,298 | B1 | 6/2002 | Lenz | |
| 8,214,973 | B2 * | 7/2012 | Salice | E05D 11/1021 16/284 |

* cited by examiner

FURNITURE HINGE

FIELD OF THE INVENTION

The present invention relates to a furniture hinge.

BACKGROUND OF THE INVENTION

Generally speaking, furniture hinges are designed to enable a movable component (e.g., a door) of a piece of furniture (e.g., a cabinet) to be opened and closed with respect to a stationary component (e.g., the frame of the cabinet). U.S. Pat. No. 6,401,298 B1, for example, discloses a furniture hinge that includes a hinge casing and a hinge arm. The hinge casing and the hinge arm are adapted to be mounted on different furniture parts respectively and are connected to each other by means of a plurality of hinge links. A pressure spring (e.g., a leg spring) acts on one of the hinge links and has a portion encircling a hinge axle of the hinge link in order to mount the pressure spring to the hinge axle. The disclosure of this patent is incorporated herein by reference.

While FIG. 3 of the '298 B1 patent shows the U-shaped leg spring 13 encircling the third axle 11, the U-shaped leg spring can only lie against the hinge arm 1, rather than be secured at a predetermined position, when not yet, but ready to be, mounted to the third axle.

During assembly, therefore, the furniture hinge disclosed in the '298 B1 patent leaves something to be desired. The present invention was developed in the light of the foregoing.

SUMMARY OF THE INVENTION

The present invention provides a furniture hinge in which a resilient device can be secured at a predetermined position in the initial stage of assembly so that stability of the resilient arrangement of the furniture hinge is ensured.

According to one aspect of the present invention, a furniture hinge includes an arm member, a casing, an inner link, an outer link, and a resilient device. The arm member includes at least one wall. The at least one wall includes a first mounting structure. The casing can be opened and closed with respect to the arm member. The inner link has a first end portion and a second end portion opposite the first end portion. The first end portion of the inner link is pivotally connected to the arm member via a first shaft while the second end portion of the inner link is pivotally connected to the casing via a second shaft. The outer link also has a first end portion and a second end portion opposite the first end portion. The first end portion of the outer link is pivotally connected to the arm member via a third shaft while the second end portion of the outer link is pivotally connected to the casing via a fourth shaft. The resilient device provides a resilient force acting between the casing and the arm member and includes a second mounting structure to be mounted to the first mounting structure.

Preferably, the furniture hinge is applicable to a furniture part assembly that includes a first furniture part and a second furniture part, wherein the second furniture part can be opened and closed with respect to the first furniture part. Moreover, the arm member is mountable to the first furniture part, and the casing is mountable to the second furniture part.

Preferably, one of the first mounting structure and the second mounting structure includes a projection, and the other of the first mounting structure and the second mounting structure includes a recess matching the projection.

Preferably, the resilient device includes a first resilient member. The first resilient member includes a first resilient portion, a second resilient portion, and a first bent portion connected between the first resilient portion and the second resilient portion.

Preferably, the first resilient portion has the second mounting structure.

Preferably, the resilient device further includes a second resilient member. The second resilient member includes a third resilient portion, a fourth resilient portion, and a second bent portion connected between the third resilient portion and the fourth resilient portion. The third resilient portion, the fourth resilient portion, and the second bent portion of the second resilient member define a space for accommodating the first resilient member. The third resilient portion also has the second mounting structure.

Preferably, the second resilient portion of the first resilient member is configured to be pressed by the first end portion of the inner link.

Preferably, the fourth resilient portion of the second resilient member is configured to be pressed by the first end portion of the inner link.

Preferably, the furniture hinge further includes a cap attached to the inner link at a position adjacent to the first end portion of the inner link, and one of the second resilient portion of the first resilient member and the fourth resilient portion of the second resilient member has a guide surface corresponding to the cap.

Preferably, the cap includes plastic.

Preferably, the first resilient member and the second resilient member are resilient U-shaped plates.

Preferably, the arm member includes a first wall, a second wall, and a third wall connected between the first wall and the second wall. The first mounting structure is located at the third wall.

DETAILED DESCRIPTION OF THE INVENTION

Figure 1:
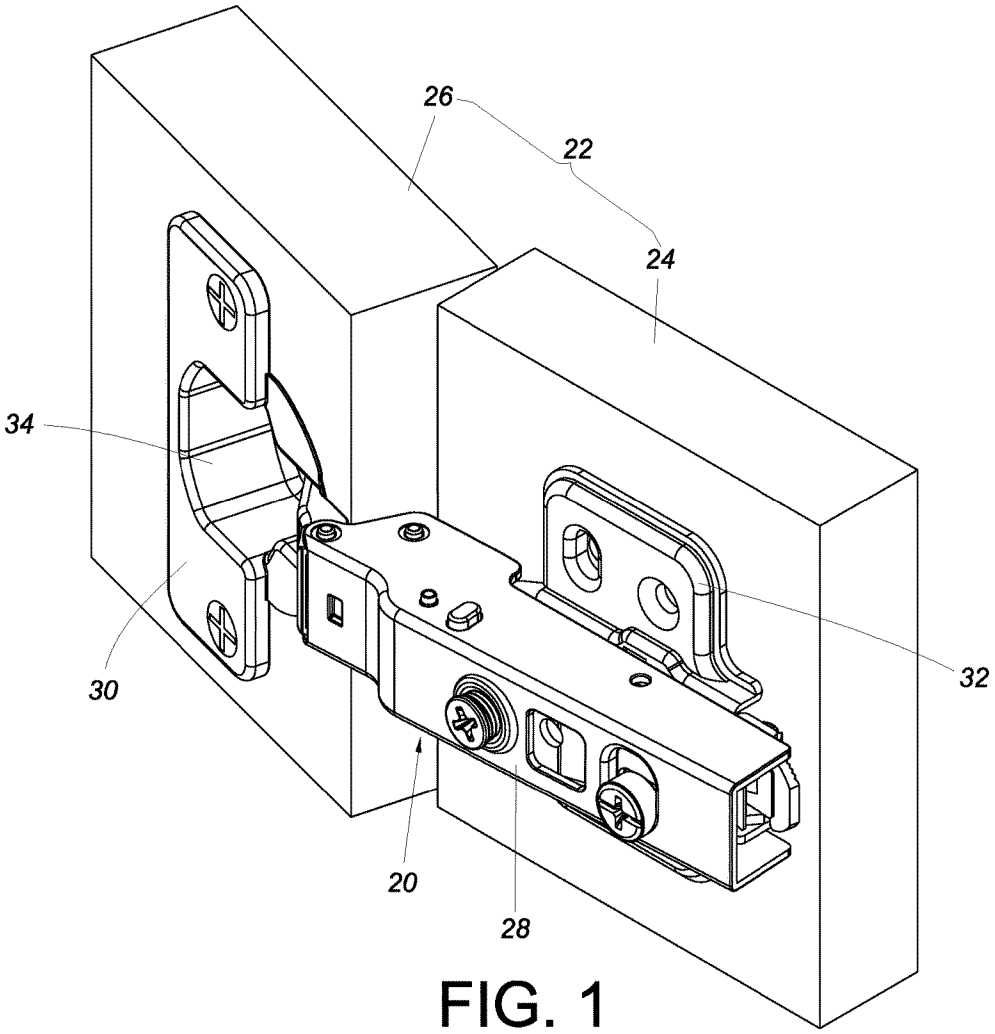
FIG. 1 is a perspective view in which the furniture hinge in an embodiment of the present invention is applied to a furniture part assembly.

Referring to FIG. 1, the furniture hinge 20 in an embodiment of the present invention is applied to a furniture part assembly 22. The furniture part assembly 22 includes a first furniture part 24 (e.g., the frame of a cabinet) and a second furniture part 26 (e.g., a door of the cabinet). The second furniture part 26 can be opened and closed with respect to the first furniture part 24.

The furniture hinge 20 includes an arm member 28 and a casing 30. The arm member 28 is a hinge arm and is configured to be mounted to the first furniture part 24. For example, the arm member 28 can be threadedly connected to the first furniture part 24. In this embodiment, the arm member 28 is mounted to the first furniture part 24 via a fitting 32. The casing 30, on the other hand, is a hinge cup and has a receiving room 34. The casing 30 is configured to be mounted to the second furniture part 26. For instance, the casing 30 can be threadedly connected to the second furniture part 26.

Figure 2:
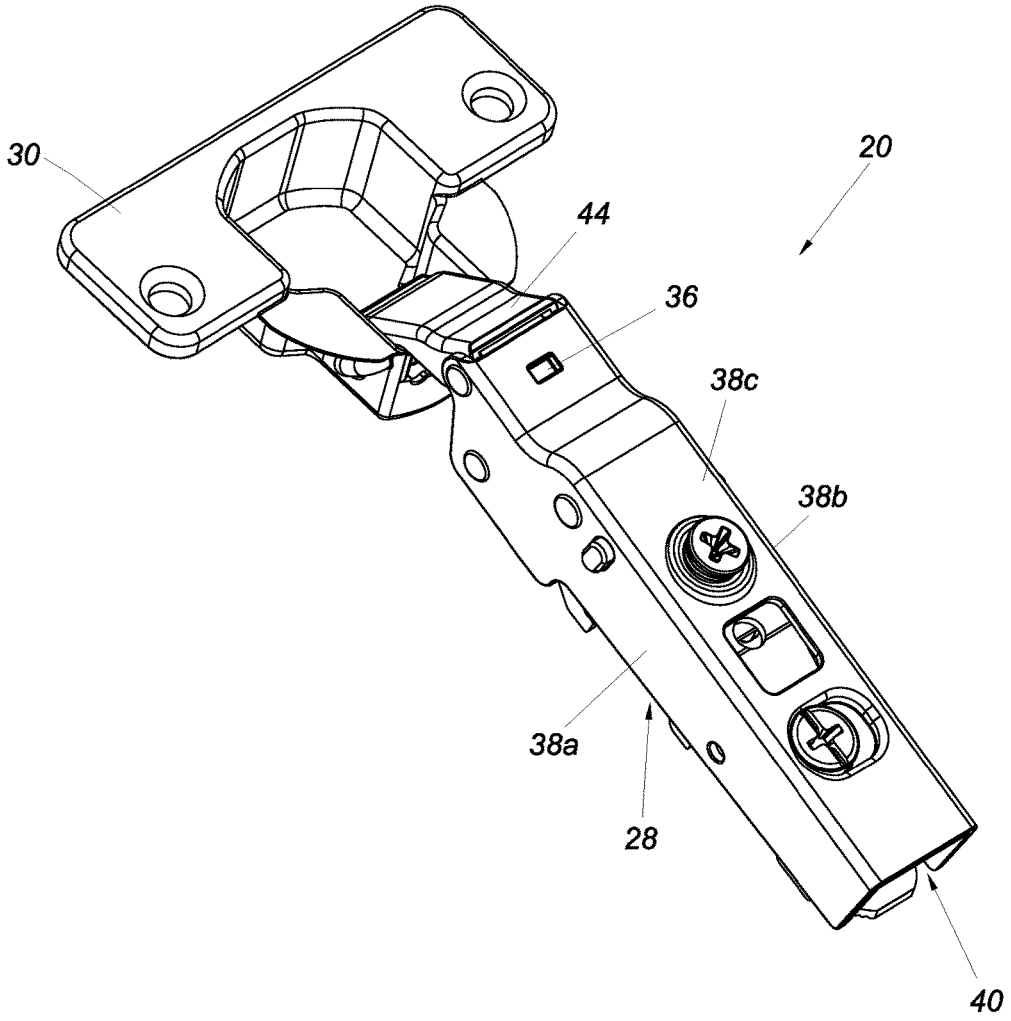
FIG. 2 is an assembled perspective view of the furniture hinge in an embodiment of the present invention.
Figure 3:
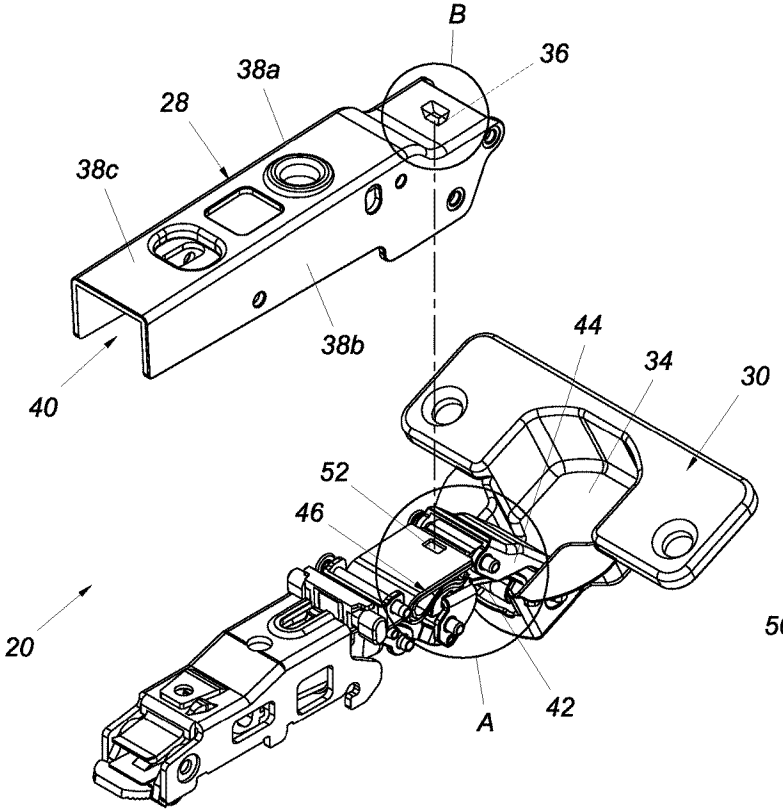
FIG. 3 is an exploded perspective view of the furniture hinge in an embodiment of the present invention.

As shown in FIG. 2 and FIG. 3 the arm member 28 of the furniture hinge 20 includes at least one wall, and the at least one wall includes a first mounting structure 36. Here, the arm member 28 includes a first wall 38*a*, a second wall 38*b*, and a third wall 38*c* (or middle wall 38*c*) connected between the first wall 38*a* and the second wall 38*b*; and the first mounting structure 36 is located at the third wall 38*c* by way of example. More specifically, the first wall 38*a* and the second wall 38*b* are substantially perpendicularly connected to the third wall 38*c*; and the first wall 38*a*, the second wall 38*b*, and the third wall 38*c* jointly define an accommodating space 40 for accommodating related components of the furniture hinge 20.

Figure 4:
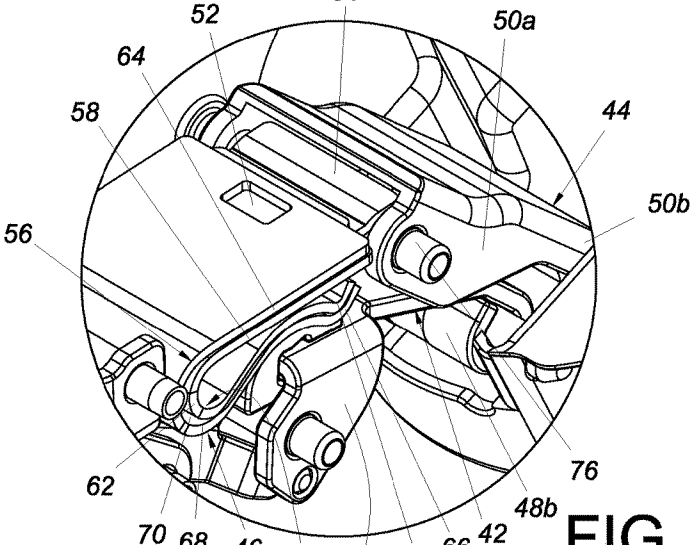
FIG. 4 is an enlarged view of the area A in FIG. 3.

As shown in FIG. 3 and FIG. 4, the furniture hinge 20 further includes an inner link 42, an outer link 44, and a resilient device 46.

Figure 5:
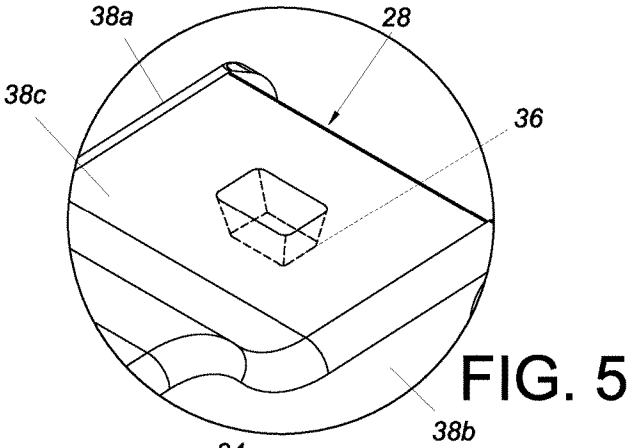
FIG. 5 is an enlarged view of the area B in FIG. 3.

The inner link 42 has a first end portion 48*a* and a second end portion 48*b* opposite the first end portion 48*a*. The outer link 44 has a first end portion 50*a* and a second end portion 50*b* opposite the first end portion 50*a*. The resilient device 46 includes a second mounting structure 52 configured to be mounted to the first mounting structure 36 of the arm member 28 (see also FIG. 5 and FIG. 7). The first mounting structure 36 and the second mounting structure 52 may be a projection and a matching recess. In this embodiment, the first mounting structure 36 is a projecting portion while the second mounting structure 52 is a groove or hole in which the projecting portion can be mounted. In practice, however, the second mounting structure 52 may alternatively be a projecting portion while the first mounting structure 36 is a matching groove or hole; the present invention has no limitation in this respect. The foregoing arrangement is intended to keep the resilient device 46 securely at a predetermined position on the arm member 28 in the initial stage of assembly.

Preferably, the resilient device 46 includes a first resilient member 54 and a second resilient member 56. The first resilient member 54 and the second resilient members 56 are preferably resilient U-shaped plates. The first resilient member 54 and the second resilient members 56 support and press against each other. More specifically, the first resilient member 54 includes a first resilient portion 58, a second resilient portion 60, and a first bent portion 62 connected between the first resilient portion 58 and the second resilient portion 60. Similarly, the second resilient member 56 includes a third resilient portion 64, a fourth resilient portion 66, and a second bent portion 68 connected between the third resilient portion 64 and the fourth resilient portion 66. The third resilient portion 64, the fourth resilient portion 66, and the second bent portion 68 of the second resilient member 56 define a space 70 for accommodating the first resilient member 54. The third resilient portion 64 and the fourth resilient portion 66 of the second resilient member 56 are so configured that the first resilient portion 58 and the second resilient portion 60 of the first resilient member 54 press against the third resilient portion 64 and the fourth resilient portion 66 respectively, thus turning the first resilient member 54 and the second resilient member 56 into a double-layer resilient structure. It is worth mentioning that while the second mounting structure 52 is shown in the drawings as located at the third resilient portion 64 of the second resilient member 56, it is feasible in another embodiment that the first resilient portion 58 of the first resilient member 54 also has the second mounting structure 52.

Figure 6:
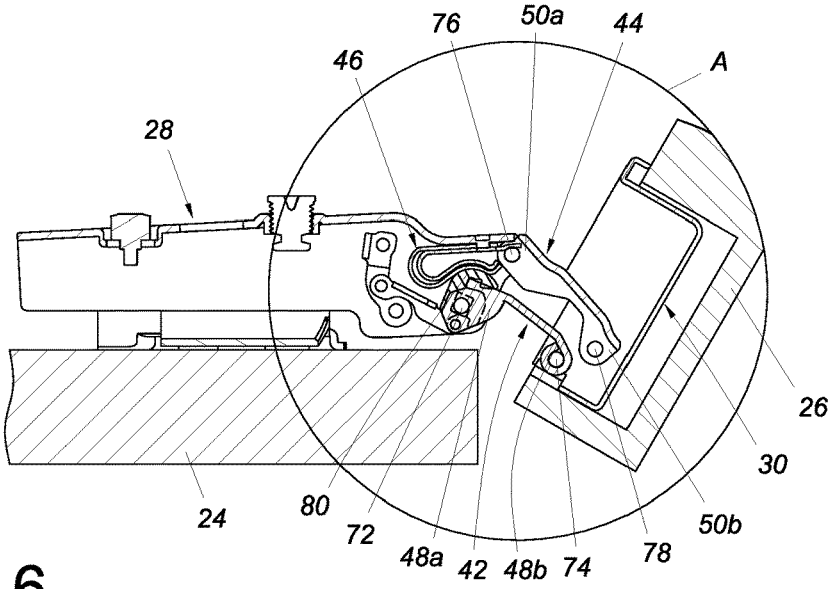
FIG. 6 is a sectional view showing the furniture hinge in an embodiment of the present invention applied to the first furniture part and the second furniture part of the furniture part assembly, with the casing of the furniture hinge at an opened position with respect to the arm member.
Figure 7:
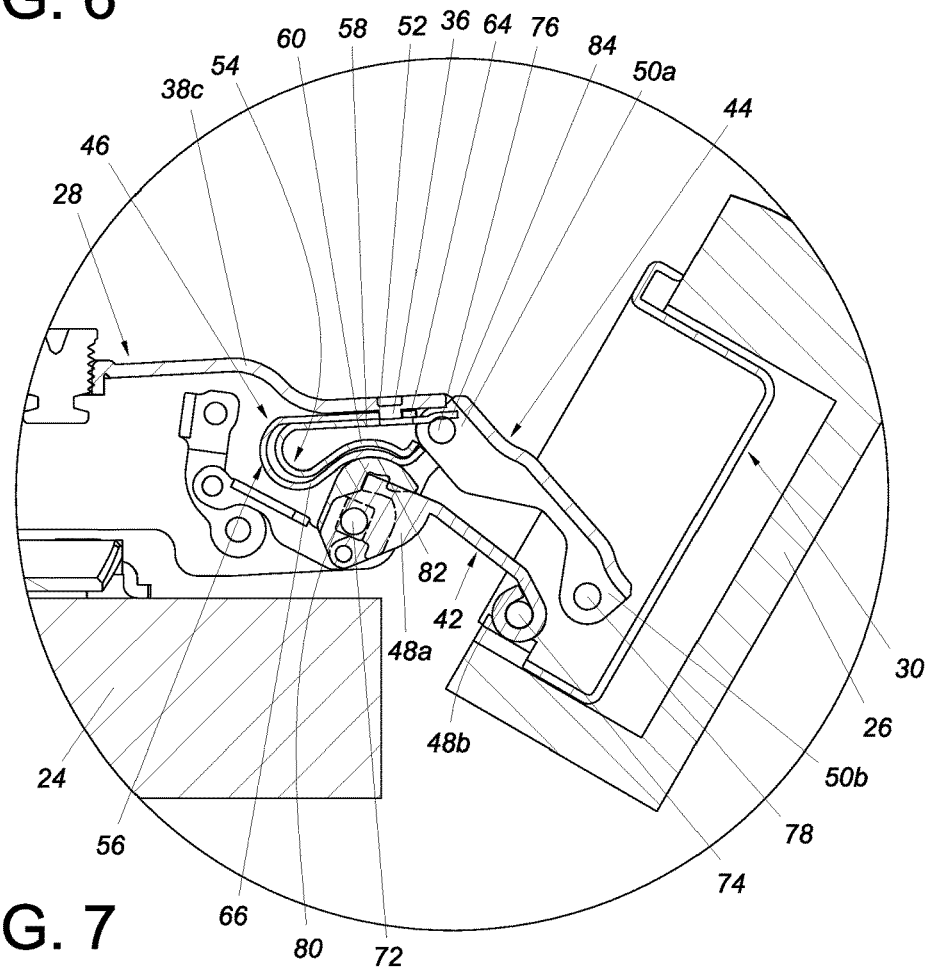
FIG. 7 is an enlarged view of the area A in FIG. 6.

As shown in FIG. 6 and FIG. 7, the casing 30 (or the second furniture part 26) can be opened with respect to the arm member 28 (or the first furniture part 24). The resilient device 46 provides a resilient force acting between the casing 30 and the arm member 28. The second mounting structure 52 of the resilient device 46 is mounted or positioned in the first mounting structure 36 of the arm member 28.

More specifically, the first end portion 48*a* of the inner link 42 is pivotally connected to the arm member 28 through a first shaft 72, and the second end portion 48*b* of the inner link 42 is pivotally connected to the casing 30 through a second shaft 74. Similarly, the first end portion 50*a* of the outer link 44 is pivotally connected to the arm member 28 through a third shaft 76, and the second end portion 50*b* of the outer link 44 is pivotally connected to the casing 30 through a fourth shaft 78. Preferably, the second resilient portion 60 of the first resilient member 54 and/or the fourth resilient portion 66 of the second resilient member 56 is configured to be pressed by the first end portion 48*a* of the inner link 42. Preferably, the furniture hinge 20 further includes a cap 80 attached to the inner link 42 at a position adjacent to the first end portion 48*a*, and the second resilient portion 60 of the first resilient member 54 and/or the fourth resilient portion 66 of the second resilient member 56 has a corresponding guide surface 82, such as a curved surface. The guide surface 82 is in contact with the cap 80 when the casing 30 (or the second furniture part 26) is opened with respect to the arm member 28 (or the first furniture part 24). Preferably, the cap 80 includes plastic and has a portion encircling the periphery of the first shaft 72. Preferably, the first resilient portion 58 of the first resilient member 54 has a first length, the third resilient portion 64 of the second resilient member 56 has a second length, and the first length is greater than the second length such that the first resilient portion 58 has an extension section 84 not only protruding a certain distance beyond the third resilient portion 64, but also corresponding or adjacent to the third shaft 76. For example, the extension section 84 of the first resilient portion 58 of the first resilient member 54 lies between the third wall 38*c* of the arm member 28 and the third shaft 76.

In addition, the inner side of the third wall 38*c* of the arm member 28 is pressed by the first resilient portion 58 and the third resilient portion 64 of the resilient device 46, and the cap 80 is pressed by the second resilient portion 60 and the fourth resilient portion 66 of the resilient device 46.

Figure 8:
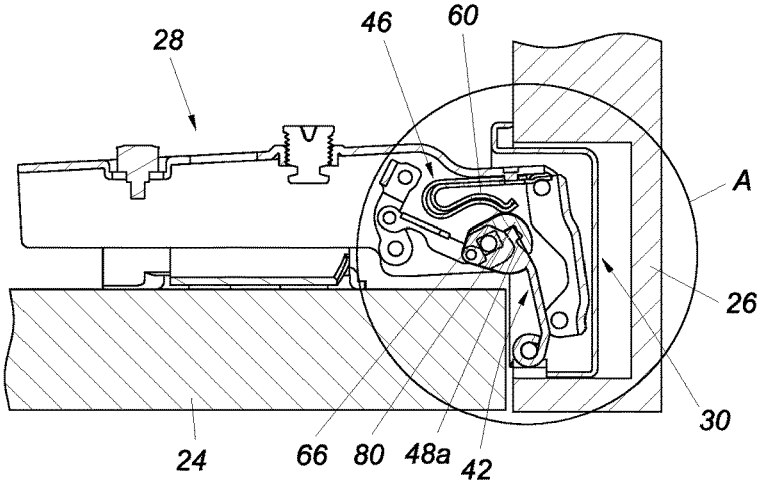
FIG. 8 is similar to FIG. 6 except that the casing of the furniture hinge is at a closed position with respect to the arm member.

As shown in FIG. 6 and FIG. 8, the casing 30 (or the second furniture part 26) can be moved from the opened position to a closed position with respect to the arm member 28 (or the first furniture part 24) by a user's operation. In the course in which the casing 30 (or the second furniture part 26) is moved from the opened position to the closed position with respect to the arm member 28 (or the first furniture part 24), the resilient device 46 provides a resilient force acting between the casing 30 and the arm member 28, thereby imparting a force (e.g., a closing force) to the casing 30 that tends to move the casing 30 from the opened position to the closed position with respect to the arm member 28.

Figure 9:
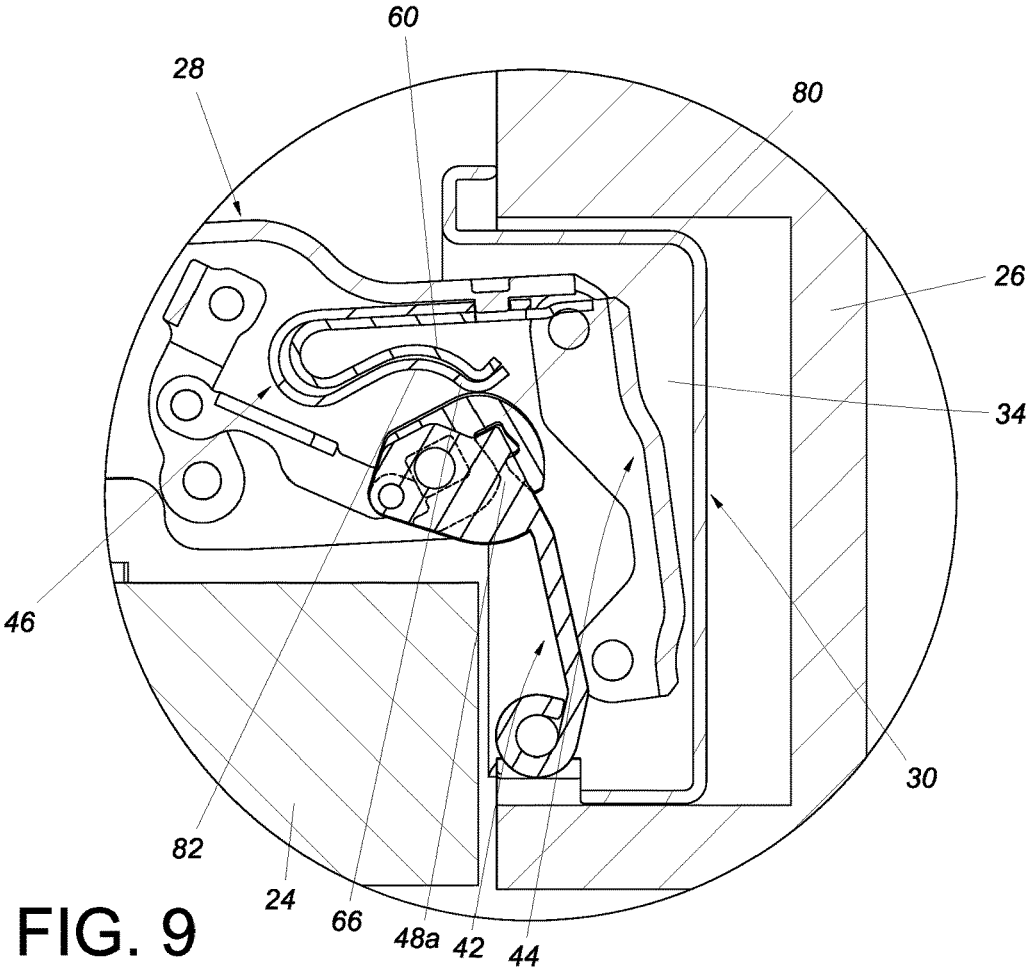
FIG. 9 is an enlarged view of the area A in FIG. 8.

Referring to FIG. 8 and FIG. 9, when the casing 30 (or the second furniture part 26) is closed with respect to the arm member 28 (or the first furniture part 24), the cap 80 is away from the guide surface 82, and the first end portion 48*a* of the inner link 42 presses the second resilient portion 60 and the fourth resilient portion 66 of the resilient device 46 through the cap 80. Moreover, the inner link 42 and the outer link 42 are accommodated in the receiving room 34 of the casing 30.

According to the above, the resilient device of the furniture hinge of the present invention can be fixed at a predetermined position in the initial stage of assembly to ensure stability of the resilient arrangement of the furniture hinge.

While the present invention has been disclosed by way of the foregoing preferred embodiments, it should be understood that the embodiments provided herein are not intended to be restrictive of the invention. The scope of patent protection sought by the applicant is defined by the appended claims.

What is claimed is:

1. A furniture hinge applicable to a furniture part assembly including a first furniture part and a second furniture part configured to be opened and closed with respect to the first furniture part, the furniture hinge comprising:

an arm member mountable to the first furniture part of the furniture part assembly, wherein the arm member includes at least one wall, and the at least one wall includes a first mounting structure;

a casing mountable to the second furniture part of the furniture part assembly;

an inner link having a first end portion and a second end portion opposite the first end portion, wherein the first end portion of the inner link is pivotally connected to the arm member via a first shaft, and the second end portion of the inner link is pivotally connected to the casing via a second shaft;

an outer link having a first end portion and a second end portion opposite the first end portion, wherein the first end portion of the outer link is pivotally connected to the arm member via a third shaft, and the second end portion of the outer link is pivotally connected to the casing via a fourth shaft; and a resilient device captured between the arm member and the inner link for providing a resilient force acting between the casing and the arm member, wherein the resilient device includes a second mounting structure to be mounted to the first mounting structure of the arm member, the resilient device defining a first resilient portion terminating at an extension section engaging the third shaft in substantially tangential manner.

2. The furniture hinge of claim 1, wherein one of the first mounting structure and the second mounting structure includes a projection, and the other of the first mounting structure and the second mounting structure includes a recess matching the projection.

3. The furniture hinge of claim 1, wherein the resilient device includes a first resilient member; and the first resilient member includes the first resilient portion and a second resilient portion, the first resilient member further including a first bent portion connected between the first resilient portion and the second resilient portion.

4. The furniture hinge of claim 3, wherein the resilient device includes a second resilient member; the second resilient member includes a third resilient portion, a fourth resilient portion, and a second bent portion connected between the third resilient portion and the fourth resilient portion; the third resilient portion, the fourth resilient portion, and the second bent portion of the second resilient member define a space for accommodating the first resilient member; and the third resilient portion has the second mounting structure.

5. The furniture hinge of claim 3, wherein the second resilient portion of the first resilient member is configured to be pressed by the first end portion of the inner link.

6. The furniture hinge of claim 4, wherein the fourth resilient portion of the second resilient member is configured to be pressed by the first end portion of the inner link.

7. The furniture hinge of claim 6, further comprising a cap attached to the inner link at a positon adjacent to the first end portion of the inner link, and at least one of the second resilient portion of the first resilient member and the fourth resilient portion of the second resilient member has a guide surface corresponding to the cap.

8. The furniture hinge of claim 7, wherein the cap includes plastic.

9. The furniture hinge of claim 4, wherein the first resilient member and the second resilient member are resilient U-shaped plates.

10. The furniture hinge of claim 1, wherein the arm member includes a first wall, a second wall, and a third wall connected between the first wall and the second wall; and the first mounting structure is located at the third wall.

11. The A furniture hinge, comprising:

an arm member including at least one wall, wherein the at least one wall includes a first mounting structure;

a casing configured to be opened and closed with respect to the arm member;

an inner link having a first end portion and a second end portion opposite the first end portion, wherein the first end portion of the inner link is pivotally connected to the arm member via a first shaft, and the second end portion of the inner link is pivotally connected to the casing via a second shaft;

an outer link having a first end portion and a second end portion opposite the first end portion, wherein the first end portion of the outer link is pivotally connected to the arm member via a third shaft, and the second end portion of the outer link is pivotally connected to the casing via a fourth shaft; and a resilient device captured between the arm member and the inner link for providing a resilient force acting between the casing and the arm member, wherein the resilient device includes a second mounting structure configured to be mounted to the first mounting structure of the arm member, the resilient device defining a first resilient portion terminating at an extension section engaging the third shaft in substantially tangential manner.

12. The furniture hinge of claim 11, wherein one of the first mounting structure and the second mounting structure includes a projection, and the other of the first mounting structure and the second mounting structure includes a recess matching the projection.

13. The furniture hinge of claim 11, wherein the resilient device includes a first resilient member; and the first resilient member includes the first resilient portion and a second resilient portion, the first resilient member further including a first bent portion connected between the first resilient portion and the second resilient portion.

14. The furniture hinge of claim 13, wherein the resilient device includes a second resilient member; the second resilient member includes a third resilient portion, a fourth resilient portion, and a second bent portion connected between the third resilient portion and the fourth resilient portion; the third resilient portion, the fourth resilient portion, and the second bent portion of the second resilient member define a space for accommodating the first resilient member; and the third resilient portion has the second mounting structure.

15. The furniture hinge of claim 13, wherein the second resilient portion of the first resilient member is configured to be pressed by the first end portion of the inner link.

16. The furniture hinge of claim 14, wherein the fourth resilient portion of the second resilient member is configured to be pressed by the first end portion of the inner link.

17. The furniture hinge of claim 16, further comprising a cap attached to the inner link at a positon adjacent to the first end portion of the inner link, and at least one of the second resilient portion of the first resilient member and the fourth resilient portion of the second resilient member has a guide surface corresponding to the cap.

18. The furniture hinge of claim 17, wherein the cap includes plastic.

19. The furniture hinge of claim 14, wherein the first resilient member and the second resilient member are resilient U-shaped plates.

20. The furniture hinge of claim 11, wherein the arm member includes a first wall, a second wall, and a third wall connected between the first wall and the second wall; and the first mounting structure is located at the third wall.

* * * * *